US005796184A

United States Patent [19]

Kuhnl et al.

[11] Patent Number: 5,796,184

[45] Date of Patent: *Aug. 18, 1998

[54] METHOD AND AN APPARATUS FOR STOPPING A MOTOR-DRIVEN PRESSURE GENERATING PUMP OF A SYSTEM FOR COATING WORKPIECES WITH ATOMIZED LIQUID COATING MATERIAL

[75] Inventors: Rudolf Kuhnl, Salem; Gerhard Gebauer, Bermatingen, both of Germany

[73] Assignee: J. Wagner GmbH, Friedrichshafen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 98,827

[22] Filed: Jul. 29, 1993

[30] Foreign Application Priority Data

Jul. 29, 1992 [DE] Germany ..... 42 25 072.2

[51] Int. Cl.[6] ..... H01H 35/18; F04B 49/00

[52] U.S. Cl. ..... 307/118; 318/461; 318/481; 318/482; 417/20; 417/22; 417/36; 417/44.2; 239/550

[58] Field of Search ..... 307/118; 318/461, 318/465, 481, 482; 239/63, 68, 69, 75, 550, 551, 562; 417/20, 22, 42, 36, 44.2, 223

[56] References Cited

U.S. PATENT DOCUMENTS

| | | | |
|---|---|---|---|
| 4,102,394 | 7/1978 | Botts | 166/65 R |
| 4,118,151 | 10/1978 | Murakami et al. | 417/223 |
| 4,225,290 | 9/1980 | Allington | 417/18 |
| 4,614,300 | 9/1986 | Falcoff | 239/71 |
| 4,686,439 | 8/1987 | Cunningham et al. | 318/335 |
| 4,789,100 | 12/1988 | Senf | 239/61 |
| 5,139,044 | 8/1992 | Otten et al. | 137/80 |
| 5,182,704 | 1/1993 | Bengtsson | 364/148 |
| 5,228,622 | 7/1993 | Murphy et al. | 239/126 |

FOREIGN PATENT DOCUMENTS

| | | |
|---|---|---|
| 0 321 295 | 6/1989 | European Pat. Off. . |
| 19 50 499 | 11/1966 | Germany . |
| 2 311 642 | 10/1973 | Germany . |
| 32 08 464 | 9/1982 | Germany . |

*Primary Examiner*—William M. Shoop, Jr.
*Assistant Examiner*—Jonathan S. Kaplan
*Attorney, Agent, or Firm*—Hill & Simpson

[57] ABSTRACT

A method and an apparatus are provided for stopping a motor-driven pressure generating pump of a system for coating workpieces with atomized liquid coating material in case of an empty material reservoir or a leakage in a material supply from a material reservoir to the pump or from the pump to an atomizer. The pressure and/or the volume flow at the pump outlet and/or the speed of the pump piston or a value dependent thereon are continually measured. The measured values are then converted to electric signals to be input to an electronic analyzer and analyzed therein. If, during operation, the pressure and/or the volume flow drops below a predetermined value and/or the speed of the piston exceeds a predetermined value, the electrically controlled driving connection between motor and pump or the power supply to the pump motor will be cut-off by output signals from the electronic analyzer.

12 Claims, 1 Drawing Sheet

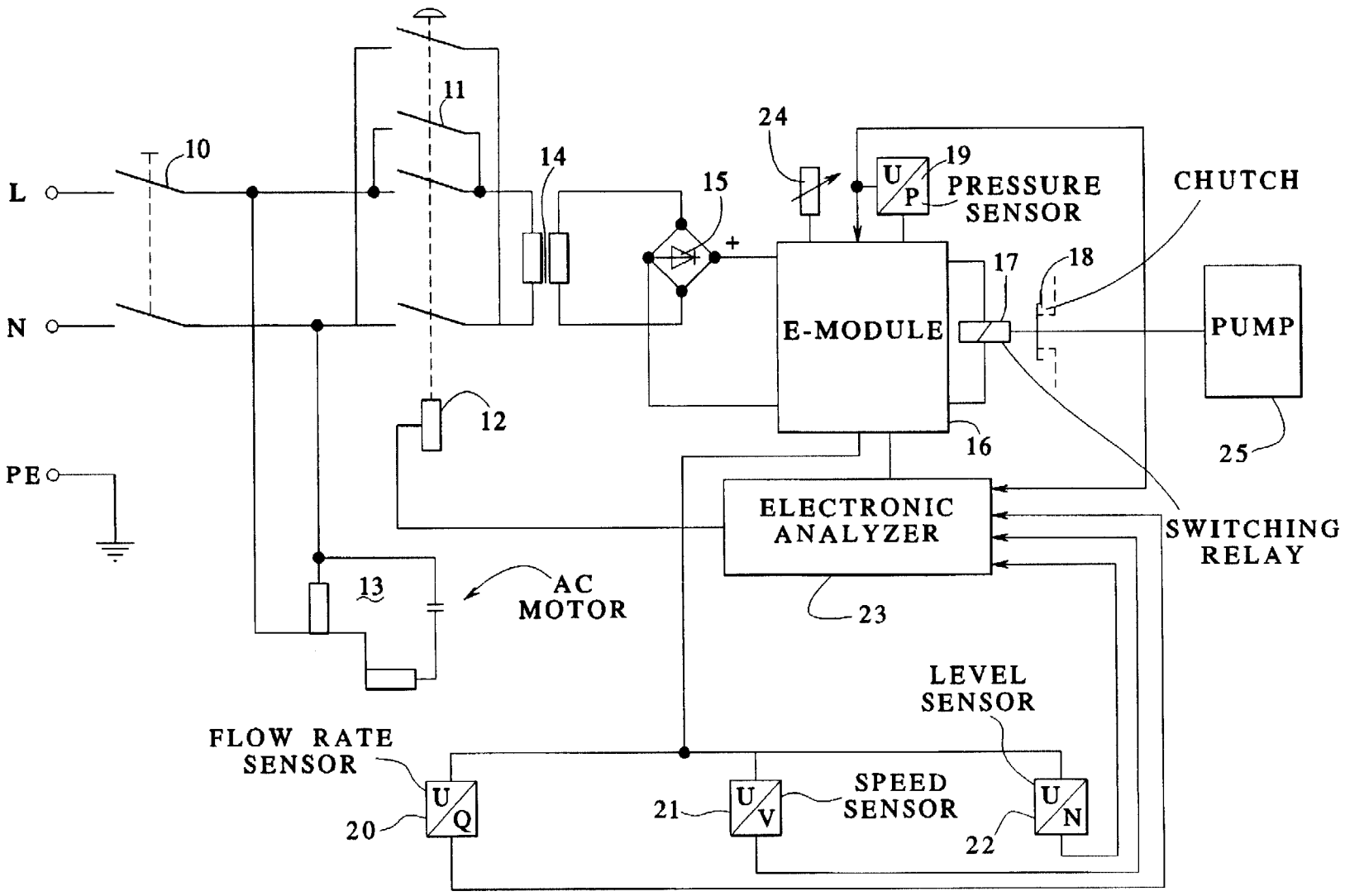
CHUTCH
PUMP
25
SWITCHING RELAY
18
17
16
PRESSURE SENSOR
19
U/P
E-MODULE
ELECTRONIC ANALYZER
23
LEVEL SENSOR
U/N
22
SPEED SENSOR
U/V
21
24
15
+
14
AC MOTOR
12
11
13
U/Q
FLOW RATE SENSOR
20
10
L
N
PE

METHOD AND AN APPARATUS FOR STOPPING A MOTOR-DRIVEN PRESSURE GENERATING PUMP OF A SYSTEM FOR COATING WORKPIECES WITH ATOMIZED LIQUID COATING MATERIAL

BACKGROUND OF THE INVENTION

The present invention generally relates to a method and an apparatus for stopping a motor-driven pressure generating pump of a system for coating workpieces with atomized liquid coating material. More specifically, the invention relates to a system for stopping the pump in case of an empty material reservoir or leakage in the material supply from a material reservoir to the pump or from the pump to an atomizer.

Reciprocating pumps are generally known for use with coating systems. Such pumps are typically driven by an electrical motor or gasoline motor through an electromagnetic clutch often with a transmission therebetween and/or a cam means with a crank mechanism.

The reciprocating pump sucks a coating material, such as paint, from a reservoir and delivers the coating material through a pressurized pipe to a spray gun. The spray gun has a manually or automatically operated valve. A nozzle is further provided downstream of the valve. The valve allows pressurized coating material to be atomized and directed to a workpiece to be coated on which the coating material is deposited.

The nozzles typically include different nozzle openings such that a load on the pump system during operation differs in accordance with the nozzle size. Moreover, when the gun valve is closed (temporary interruption of work), the drive motor continues to operate without being affected.

To this end, the pressure inside the reciprocating pump or directly at the outlet thereof is detected and converted by an electronic circuit to an electric, output signal. The output signal is applied to a coil of an electromagnetic clutch to turn the clutch ON and OFF within minimum/maximum pressure signals. As a result, the drive motor including the pump system is respectively engaged or disengaged. When a DC motor is used as the electric drive motor, the power supply for the motor is switched directly instead of using the electromagnetic clutch.

Using reciprocating pumps for delivering paints under pressure, both a piston and a piston rod are guided and sealed in packings. The packings, the piston and the cylinder liner are subjected to considerable wear due to the pigments contained in the paints. However, wear is drastically enhanced when the pump continues to run without any coating material present therein. That is, when the coating material is emptied, wear on the pump is enhanced since the coating material, such as paint, provides lubrication for the pump during use. For example, dry operation of even less than thirty seconds has been experimentally shown to cause considerable wear to the pump.

Dry operation of the pump is often due to a user who has not realized that the packing from which the coated material is sucked is empty. Or, in the alternative, the user may not be aware that one of the pump valves is not properly functioning by failing to close, for example. Still further, dry operation may result from the hose on the suction side of the pump leaking which causes air to be sucked into the pump. A further complication results from a hose on the delivery side leaking resulting in coating material spilling from the packing into the atmosphere.

SUMMARY OF THE INVENTION

The present invention provides a method for automatically turning off a reciprocating pump when no coating material is present for pumping independent of the cause or reason which the coating material is not present.

To this end, a method is provided for stopping a motor-driven pressure generating pump of a system for coating workpieces with atomized liquid coating material from a material supply within a material reservoir when the material reservoir is empty or during leakage. The method comprises the steps of continuously measuring pressure at a pump outlet; converting the measured pressure values to electric signals; supplying the electric signals to an electronic analyzer to be analyzed therein; establishing a preset value for the pressure; causing the electronic analyzer to output a signal upon measuring the pressure below the preset value; and stopping the pump providing the coating material in response to the signal from the electronic analyzer.

In an embodiment of the invention, at least one parameter—pressure, volume flow and/or piston speed—is continuously measured. The electronic analyzer provides an output for terminating the connection between the drive motor and the pump. In the alternative, the drive motor may be stopped when the measurement is indicative of dry operation of the pump.

In an embodiment, the method further comprises the step of establishing a minimum pressure value and a maximum pressure value defining a desired operating pressure range and a third pressure value below the minimum pressure value. The method further provides a cut-off signal from the electronic analyzer when the pressure falls below the third pressure value wherein the pump can only be restarted upon renewed manual start up of the system.

In an embodiment, an apparatus is provided for stopping a motor driven pressure generating pump for coating workpieces with an atomized liquid coating material from a material supply. The apparatus comprises a material reservoir for holding the material supply; means for continuously measuring a parameter related to the coating material; and an electronic analyzer for receiving the measured parameter wherein the electronic analyzer stores a preset value for comparing the measured parameter to the preset value and further outputs a signal upon exceeding of the preset value wherein the output signal stops the pump.

Additional features and advantages of the present invention are described in, and will be apparent from, the detail description of the presently preferred embodiments and from the drawing.

BRIEF DESCRIPTION OF THE DRAWINGS

The FIGURE illustrates a circuit diagram of an embodiment of the present invention.

DETAILED DESCRIPTION OF THE PRESENTLY PREFERRED EMBODIMENTS

The present invention provides a method and an apparatus for stopping a motor driven pressure generating pump upon detection of a condition. To this end, at least one of pressure at an outlet of the pump, volume flow at the outlet of the pump and speed of the pump are measured and converted to a respective electric signal. An electronic analyzer compares the signals to predetermined values of pressure, volume flow and speed to determine if a driving connection between a motor and the pump or an electric power supply to the motor should be cut-off. The invention is generally applicable to an apparatus and a method for coating workpieces with an atomized coating material, such as paint, but other applications for controlling flow from a pressurized container may be implemented as will be apparent.

Referring now to the FIGURE, an appliance switch 10 is connected to an AC source indicated by the terminals L, N. The output of the appliance switch 10 leads to a momentary-contact switch 11 having a relay 12. A line intermediate the appliance switch 10 and the momentary-contact switch 11 leads to an AC motor generally indicated at 13. An output from the momentary-contact switch 11 leads to a primary winding of a transformer 14, and a secondary winding of the transformer 14 is connected to a rectifier 15.

A DC output from the rectifier 15 feeds an E-module 16 which provides a source of power for a plurality of components. More specifically, the E-module 16 provides power for a switching relay 17 of a disengageable clutch 18, a pressure sensor 19, a flow rate sensor 20, a speed/rotational speed sensor 21, a level sensor 22 and an electronic analyzer 23.

The clutch 18 provides a connection between the motor 13 and a reciprocating pump illustrated generally at 25. A spraying apparatus and a device for regulating discharge volumes from, for example, a spray gun are disclosed in U.S. Pat. Nos. 4,82,899 and 5,141,162, the disclosures of which are fully incorporated herein by reference.

The pressure sensor 19 as shown in the FIGURE detects the pressure at the inlet or the outlet of the reciprocating pump and produces a signal corresponding thereto. In addition, the flow rate sensor 20 detects the flow rate at the input or the outlet of the reciprocating pump generating a signal corresponding to the flow rate. Further, the speed/rotational speed sensor 21 detects the speed or the rotational speed of the pump piston and generates a signal indicative thereof. Finally, the level sensor 22 detects liquid level or other material level in a reservoir (not illustrated) for conversion to a signal. Each of the signals may be in the form of an electrical signal, such as a voltage signal.

The signals produced by the sensors 19, 20, 21 and 22 are supplied to the electronic analyzer 23 which, in turn, is used as a power source for the relay 12 of the momentary-contact switch 11. An operating pressure presetting switch 24 is further provided for inputting a desired maximum level and a minimum level to the E-module 16 of the operating pressure for the system. For reasons which will become apparent below, a branch line of the output signal line of the pressure sensor 19 also leads to the E-module 16 as illustrated in the FIGURE.

Operation of the system begins by inputting a maximum value and a minimum value of the desired operating pressure to the E-module 16 under control of the operating pressure presetting switch 24. Subsequently, the appliance switch 10 is closed causing the motor 13 to run. Transmission of motion, however, to the reciprocating pump is not initiated because the clutch 18 is disengaged.

When, the momentary-contact switch 11 is depressed to its closed position and is manually held in this position, the transformer 14 is thereby fed with a current providing a low voltage via the secondary winding of the transformer 14 to the rectifier 15. The rectifier 15 rectifies the low voltage and supplies the rectified low voltage to the E-module 16. The E-module 16, in turn, energizes the switching relay 17 which then causes the clutch 18 to engage resulting in initiation of the reciprocating pump. Concurrently, the E-module 16 powers the sensors 19, 20, 21 and 22 as well as the electronic analyzer 23.

The electronic analyzer 23 includes a previously stored pressure value $P_3$ stored therein. The pressure value $P_3$ corresponds to a third value in addition to a first value $P_1$ corresponding to a maximum operating pressure and a second value $P_2$ corresponding to a minimum operating pressure. The level of the pressure value $P_3$ can be freely selected provided the value $P_3$ is lower than the minimum operating pressure value $P_2$.

After a certain start-up period, the electronic analyzer 23 receives a signal from the pressure sensor 19 indicating that the pressure in the reciprocating pump has exceeded the mentioned pressure value $P_3$. When this occurs, the electronic analyzer 23 energizes the relay 12 of the momentary-contact switch 11 so that the momentary-contact switch 11 may be released. The momentary-contact switch 11 is then held by the relay 12 in its lowermost closed position. In a preferred embodiment, an indicator lamp (not shown) may be provided on an electronic display to inform an operator as to when the momentary-contact switch 11 may be released.

With continuing pump movement, the pressure in the reciprocating pump eventually reaches the preselected maximum pressure $P_1$. At this point, the E-module 16 is informed accordingly by a signal from the pressure sensor 19. Thereupon, the E-module 16 cuts off the current supply to the relay 17 causing the clutch 18 to disengage and the reciprocating pump to stop. The motor 13 continues operating, however, and the E-module 16 continues supplying current to the sensors 19, 20, 21 and 22 as well as to the electronic analyzer 23. The electronic analyzer 23 continues holding of the momentary-contact switch 11 in the closed position when the pressure is in excess of the third value $P_3$.

When a spray gun (not illustrated) fed by the reciprocating pump is actuated, i.e. when a valve of the spray gun is opened, the operating pressure in the pump starts to decrease. When the preselected minimum operating pressure $P_2$ is reached, the E-module 16 supplies current to the relay 17 so that the clutch 18 is engaged and the pump begins to operate. The operating pressure will, therefore, begin to rise. During normal operation of the system, the pump is connected via the clutch 18 to the motor 13 while the operating pressure decreases to the minimum operating value $P_2$. On the other hand, the pump is disconnected from the motor 13 when the maximum operating pressure $P_1$ has been reached.

When either a reservoir is empty or a material hose from the reservoir to the pump or from the pump to the coating apparatus is ruptured, the pressure in the reciprocating pump will drop below the minimum operating pressure $P_2$. The pump continues operating until reaching the third pressure value $P_3$ stored in the electronic analyzer 23. Thereupon, the electronic analyzer 23 cuts off the current supply to the relay 12 and consequently the momentary-contact switch 11 is opened. In addition, the E-module 16 and the electronic analyzer 23 are no longer supplied with current, and the clutch 18 is disengaged causing the pump to come to a standstill. Only the motor 13 continues to run. Renewed activation of the system is possible only via renewed manual operation of the momentary-contact switch 11. Therefore, renewed manual operation typically requires successful trouble-shooting thereby identifying the problem causing the pump to stop.

The sensors 20, 21 and 22 illustrated in the FIGURE are provided as additional safety features. The level sensor 22, for instance, may be set so that cutting-off of the pump takes place when the reservoir contains only a predetermined residual quantity. Furthermore, the speed sensor 21 may provide the required safety feature even without the pressure sensor 19. In that case, a maximum piston speed or piston frequency is stored in the electronic analyzer 23. The electronic analyzer 23 then cuts off the current to the relay 12 when the speed or frequency is exceeded as detected by the speed sensor 21.

In that case, the start-up phase must be bridged by keeping the momentary-contact switch 11 manually depressed.

The same principles apply with respect to the flow rate sensor 20. However, the flow rate sensor 20 should generally be combined with a pressure sensor or with a speed/frequency sensor. This combination ensures that the electronic analyzer 23 causes cutting-off of the motor to the pump due to an excessively low flow rate only during operation of the spray gun or other like controller.

In a further embodiment of the present invention, a pressure gradient between the maximum pressure $P_1$ and the minimum pressure $P_2$ during normal spraying operation can be stored in the electronic analyzer 23 for any nozzle size of the spray gun. If, during spraying, the pressure drops faster, i.e. if the decreasing characteristic is steep, the electronic analyzer 23 may turn the system off. In this way, even very small leakages in the hose or hoses may be taken into account. That is, leakages which are less than the flow rate through the nozzles of the spray gun may be taken into account.

Finally, the electronic analyzer 23 may be connected through a line with the switching valve of the spray gun. In this way, the electronic analyzer 23 may be provided with a signal corresponding to the respective opening or closing of the valve of the spray gun. The sensors 19 and 20 may, therefore, provide information concerning the tightness of the conduits and the pump while the spray gun is in a closed state.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

We claim as our invention:

1. A method for stopping a motor-driven pressure generating pump of a system for coating workpieces with atomized liquid coating material from a material supply within a material reservoir when the material reservoir is empty or during leakage, the method comprising the steps of:

continuously measuring pressure at an outlet of the pump;

converting the measured pressure values to electric signals;

providing the electric signals to an electronic analyzer to be analyzed therein;

establishing a minimum pressure value and a maximum pressure value defining a desired operating pressure range and a third pressure value below the minimum pressure value;

adjusting pressure in the system upon manual start-up beyond at least the minimum pressure value up to the maximum pressure value;

causing the electronic analyzer to output a signal upon measuring the pressure below the third pressure value;

stopping the pump from providing the coating material in response to the signal from the electronic analyzer; and providing cut-off signals from the electronic analyzer when the pressure falls below the third pressure value, the pump can only be restarted upon renewed manual start-up of the system.

2. The method of claim 1 further comprising the steps of:

continuously monitoring pressure within the operating pressure range;

comparing the monitored pressure in the electronic analyzer with a desired pressure; and providing a cut-off signal from the electronic analyzer when a deviation between the monitored pressure and the desired pressure is detected.

3. A method for terminating a motor driven pump of a system providing coating material from a reservoir, the pump pumping the coating material through a nozzle, the nozzle having a size, the method comprising the steps of:

measuring at least one parameter relating to operation of the system;

converting the at least one measured parameter to at least one corresponding signal;

for each of a plurality of nozzle sizes, storing a minimum pressure value and a maximum pressure value defining a desired operating pressure range and a third pressure below the minimum pressure value in an analyzer;

providing the at least one signal to the analyzer;

converting the at least one signal into a measured output pressure value;

comparing the measured output pressure value to the third pressure corresponding to the nozzle stored in the analyzer; and isolating the motor from the pump thereby cutting-off the pump upon the measured output pressure value falling below the third pressure corresponding to the nozzle.

4. The method of claim 3 wherein the at least one parameter is pressure at an outlet of the pump, volume flow at an outlet of the pump, speed of a piston driving the pump and/or material level in the reservoir.

5. The method of claim 3 wherein the pump can only be manually restarted when cut-off due to the measured output pressure value falling below the third pressure.

6. The method of claim 3 wherein the parameter is material level in the reservoir and the pump is terminated upon reaching a predetermined minimum level.

7. The method of claim 3 wherein the parameter is speed and the pump is terminated upon exceeding of a predetermined speed independent of pressure in the system.

8. The method of claim 3 wherein the parameter is flow rate and the pump is terminated during operation of the system due to an excessively low flow rate.

9. An apparatus for stopping a motor driven pressure generating pump for coating workpieces with an atomized liquid coating material from a material supply, the apparatus comprising:

a material reservoir holding the material supply;

means for continuously measuring an output pressure of the coating material; and an electronic analyzer receiving the output pressure and wherein the electronic analyzer stores a minimum pressure value which is less than a desired operating pressure range, the minimum pressure value for comparing the output pressure to the minimum pressure value and further outputs a signal upon the output pressure falling below the minimum pressure value wherein the output signal causes disengagement of the pump and isolation of the pump from the motor and further requires a manual reengagement of the pump.

10. An apparatus for terminating a pressure generating pump of a system for coating workpieces with a coating material from a material supply within a reservoir and through a nozzle, the method comprising:

means for measuring pressure in a portion of the system and providing a first signal indicative thereof;

means for measuring material in the reservoir and providing a second signal indicative thereof;

means for measuring speed of the motor driving the pump and providing a third signal indicative thereof;

means for measuring a flow rate between the reservoir and the nozzle and providing a fourth signal indicative thereof;

means for analyzing the signals;

means for establishing preset cut-off values corresponding to at least one of the pressure, material level, flow rate and speed, the preset cut-off values falling outside of acceptable operating ranges for pressure, material level, flow rate and speed; and means for stopping the pump from providing the coating material and isolating the pump from the motor thereby requiring a manual re-start of the pump upon a falling below of at least one of the pressure, material and flow rate preset values or an exceeding of the speed preset value.

11. A method for terminating a motor driven pump of a system providing coating material from a reservoir comprising the steps of:

measuring a speed of a piston driving the pump;

converting the speed of the piston driving the pump to at least one corresponding signal;

providing the at least one signal to an analyzer;

comparing the at least one signal to a predetermined operating range and predetermined cut-off value stored in the analyzer, the predetermined cut-off value exceeding the predetermined operating range; and terminating the pump from providing the coating material and isolating the pump from the motor upon the at least one signal exceeding the predetermined cut-off value stored in the analyzer independent of pressure whereby the pump can only be re-started upon renewed manual start-up of the system.

12. An apparatus for stopping a motor driven pressure generating pump for coating workpieces with an atomized liquid coating material from a material supply, the apparatus comprising:

a material reservoir holding the material supply;

means for continuously measuring a speed of a piston of the motor driving the pump; and an electronic analyzer receiving the speed wherein the electronic analyzer stores a preset cut-off value that is higher than a predetermined operating range, the preset cut-off value for comparing the speed to the preset cut-off value and further outputs a signal upon exceeding of the preset value wherein the output signal causes disengagement and isolation of the pump whereby the pump can only be re-started upon renewed manual start-up of the system.

* * * * *